US009240629B2

(12) United States Patent
Kim

(10) Patent No.: US 9,240,629 B2
(45) Date of Patent: Jan. 19, 2016

(54) ANTENNA FOR VEHICLE

(71) Applicant: Hyundai Motor Company, Seoul (KR)

(72) Inventor: Joo Young Kim, Gyeonggi-do (KR)

(73) Assignee: Hyundai Motor Company, Seoul (KR)

( * ) Notice: Subject to any disclaimer, the term of this patent is extended or adjusted under 35 U.S.C. 154(b) by 191 days.

(21) Appl. No.: 14/043,200

(22) Filed: Oct. 1, 2013

(65) Prior Publication Data

US 2014/0340267 A1 Nov. 20, 2014

(30) Foreign Application Priority Data

May 20, 2013 (KR) ..... 10-2013-0056391

(51) Int. Cl.
*H01Q 1/32* (2006.01)
*H01Q 11/08* (2006.01)

(52) U.S. Cl.
CPC ..... *H01Q 1/32* (2013.01); *H01Q 1/3275* (2013.01); *H01Q 11/08* (2013.01)

(58) Field of Classification Search
CPC ..... H01Q 1/32; H01Q 1/3275; H01Q 11/08
USPC ..... 343/713, 711, 895
See application file for complete search history.

(56) References Cited

U.S. PATENT DOCUMENTS

| | | | | |
|---|---|---|---|---|
| 7,030,821 | B2 * | 4/2006 | Mathiae et al. | 343/711 |
| 2010/0013724 | A1 | 1/2010 | Ohshima et al. | |
| 2010/0136936 | A1 | 6/2010 | Jiang | |
| 2010/0265145 | A1 * | 10/2010 | Chung | 343/713 |
| 2012/0326935 | A1 | 12/2012 | Kang et al. | |

FOREIGN PATENT DOCUMENTS

| | | | |
|---|---|---|---|
| JP | 2009135741 | A | 6/2009 |
| KR | 10-2010-0061716 | | 6/2010 |
| KR | 2010-0110052 | A | 10/2010 |
| KR | 10-2012-0016410 | | 2/2012 |
| KR | 10-1129096 | | 3/2012 |
| KR | 2013-0000459 | A | 1/2013 |
| WO | 2010/114336 | A2 | 10/2010 |

* cited by examiner

*Primary Examiner* — Hoang V Nguyen
(74) *Attorney, Agent, or Firm* — Mintz Levin Cohn Ferris Glovsky and Popeo, P.C.; Peter F. Corless

(57) ABSTRACT

An antenna for a vehicle is provided which includes a first printed circuit board coupled to an upper part of the base, in which at least one ground feeding point is formed and a second printed circuit board coupled to the first printed circuit board in a vertical direction on the upper part of the first printed circuit board. A monopole antenna is coupled to a first side of the second printed circuit board and a first pattern radiates a coupled signal by being coupled to the ground feeding point electrically on the first side of the second printed circuit board.

7 Claims, 4 Drawing Sheets

<Prior Art>

ANTENNA FOR VEHICLE

CROSS-REFERENCE TO RELATED APPLICATION

This application claims the benefit under 35 U.S.C. §119 a of a Korean patent application filed in the Korean Intellectual Property Office on May 20, 2013 and assigned Serial No. 10-2013-0056391, and the entire disclosure of which is hereby incorporated by reference

BACKGROUND

1. Field of the Invention

The present invention relates to an antenna for a vehicle, and more particularly, to an antenna for a vehicle that minimizes a return loss generated due to an effect of a vehicle loop ground.

2. Description of the Related Art

In general, a conventional communication for a vehicle receives a radio frequency signal such as an Amplitude Modulation (AM) and a Frequency Modulation (FM). For a signal reception of the existing AM and FM band, a glass antenna in which an antenna function is embedded to a window hot-wire has been widely used. In addition to this embedded glass antenna, an external antenna such as a whip antenna or a rod type pole antenna which connects a vertical conducting wire of a $\pi/4$ length to a coaxial cable and uses a vehicle itself as a ground connection is used.

Due to the development of communication technology, a vehicle is able to support a broadcasting such as a digital multimedia broadcasting (DMB), XM®, SIRIUS®, digital multimedia broadcasting (DMMB), digital television (DTV), code division multiple access (CDMA), and global positioning system (GPS), in addition to an AM/FM signal. Accordingly, the development of antenna suitable to broadcasting band is important, but the existing glass antenna may be insufficient to satisfy such a demand. In addition, due to an increase of an electronic sub assembly (ESA), the radiation noise of electronic equipment within a vehicle flows back into the vehicle via the vehicle antenna, affecting the reception performance of broadcasting. In particular, the glass antenna has a structure in which the radiation noise of electronic equipment of vehicle flows back into the vehicle, and the directivity of antenna is not identical in all directions (e.g., omnidirectional), thus decreasing the reception performance.

However, the shark fin shaped antenna mounted on a vehicle loop may implement a robust design (e.g., blocking by vehicle loop) in the directivity and the inflow of the radiation noise of electronic equipment unit of vehicle thus improving the reception performance of radio. However, reception sensitivity of antenna may occur due to the miniaturization of AM/FM radio. FIG. 1 is an exemplary detailed view illustrating a structure of a shark antenna for a vehicle which is used in the related art.

Referring to FIG. 1, the conventional shark antenna for the vehicle includes a case 11, a base 12, a printed circuit board 13, a chip antenna 14, and a helical antenna 15. The case 11 is shaped as a shark fin and has an open lower end, and accommodates the printed circuit board 13, the chip antenna 14, and the helical antenna 15. The chip antenna 14 receives a GPS or a CDMA signal, and the helical antenna 15 receives a DMB signal. The chip antenna 14 and the helical antenna 15 are electrically connected to the printed circuit board 13 respectively, and deliver the GPS or the CDMA signal, and the DMB signal received from each antenna to a coaxial cable which is connected to a receiver since a conductive pattern is formed in the printed circuit board 13.

The helical antenna 15 is an antenna made of a metal wire wound in the shape of a spiral helix. A height of the helical antenna is set to the height that may receive the DMB signal, however, it may not be possible to receive a low frequency signal such as an AM/FM with the helical antenna of the conventional shark antenna. The shark antenna is an antenna which has been designed in consideration of the vehicle aesthetics and a function of the antenna, however, the aesthetics of the vehicle may be deteriorated since the height of the shark antenna may be excessively increased when receiving a signal of a low frequency band such as an AM/FM with the helical antenna. In addition, due to a nature of a FM monopole shark antenna which is mounted to a vehicle loop, a return loss may be frequently generated due to the effect of the vehicle loop ground, and accordingly, an insufficient impendence matching of a radiation board may occur.

SUMMARY

The present invention provides an antenna for a vehicle which minimizes a return lost generated due to a loop ground effect of a vehicle. The present invention further provides an antenna for a vehicle which may be a monopole antenna that has a shorter length than a conventional monopole antenna mounted to an interior of a shark antenna.

In accordance with an aspect of the present invention the antenna for a vehicle may include a base in which an attaching surface mounted to a vehicle is formed; a first printed circuit board, coupled to an upper part of the base, in which at least one ground feeding point is formed; a second printed circuit board coupled to the first printed circuit board in a vertical direction on the upper part of the first printed circuit board; and a monopole antenna coupled to one side of the second printed circuit board; wherein a first pattern radiates a coupled signal by being coupled to the ground feeding point electrically on one side of the second printed circuit board. A third pattern connected to a signal feeding unit may be formed on the first printed circuit board on the other side of the second printed circuit board. A pair of a second pattern connected to a ground feeding unit connected respectively to a pair of a ground feeding point which is formed in the first printed circuit board may be formed on the other side of the second printed circuit board.

The second pattern and the third pattern may be connected respectively. The second pattern and the third pattern may be formed as a meander type, and as a $\pi/4$ pattern. One second pattern and the third pattern may operate as a radiator in a specific frequency, and another second pattern may operate for frequency tuning. The first pattern may include: a first ground feeding unit connected to the ground feeding point in which a coupling effect is generated, when one second pattern and the third pattern operate as a radiator; and a pattern unit connected to the first ground feeding unit, and radiates a coupled signal generated from the first ground feeding unit. The pattern unit may be formed as a meander type and formed as a $\lambda/2$ pattern.

BRIEF DESCRIPTION OF THE DRAWINGS

The objects, features and advantages of the present invention will be more apparent from the following detailed description in conjunction with the accompanying drawings, in which.

DETAILED DESCRIPTION

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Exemplary embodiments of the present invention are described with reference to the accompanying drawings in detail. The same reference numbers are used throughout the drawings to refer to the same or like parts. Detailed descriptions of well-known functions and structures incorporated herein may be omitted to avoid obscuring the subject matter of the present invention.

Figure 1:
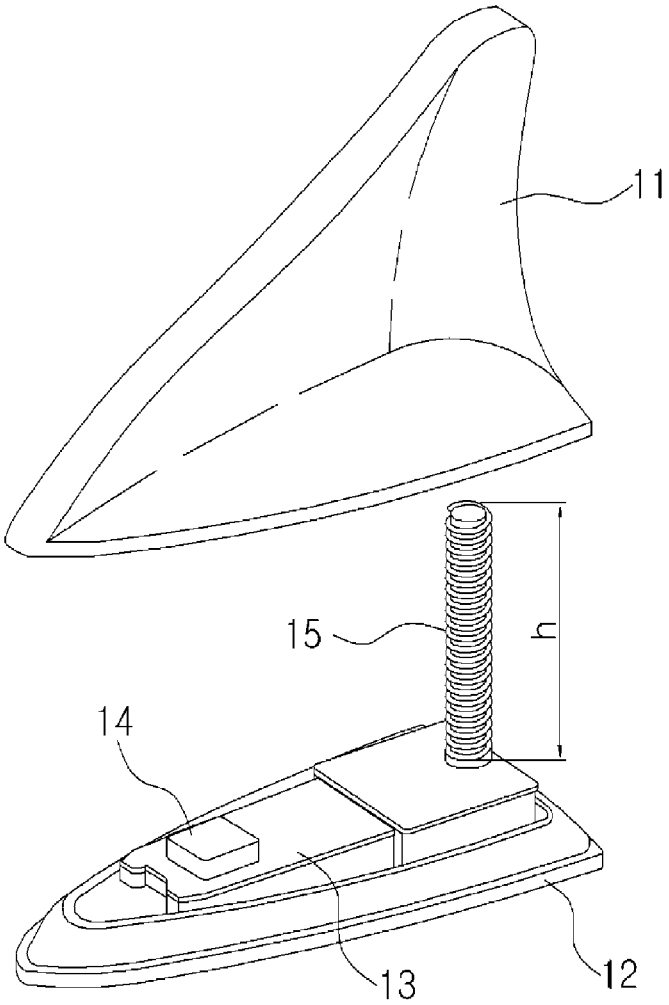
FIG. 1 is an exemplary detailed view illustrating a structure of a shark antenna for a vehicle according to a related art; pub.10-2011-0066639(kr)
Figure 2:
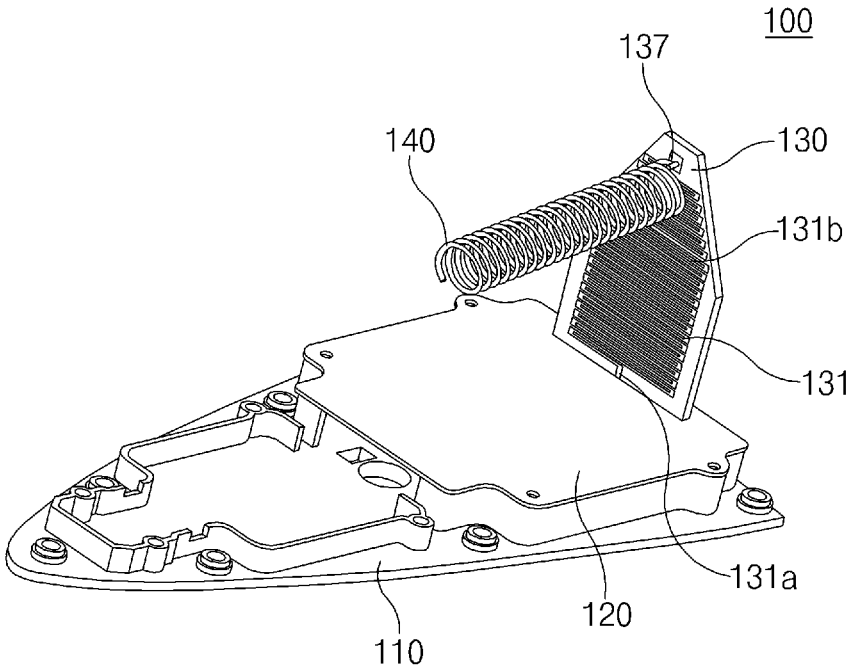
FIGS. 2 and 3 are exemplary views illustrating a structure of an antenna for a vehicle according to an exemplary embodiment of the present invention.
Figure 3:
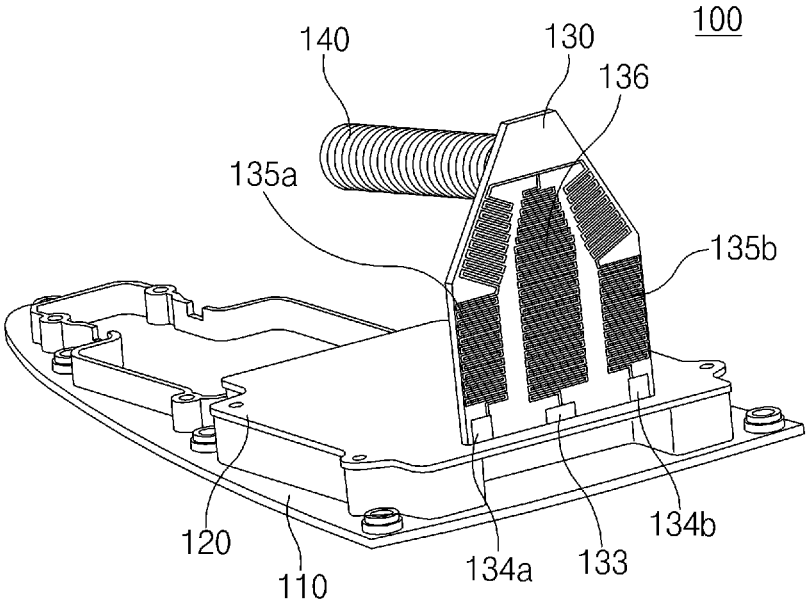
Figure 4:
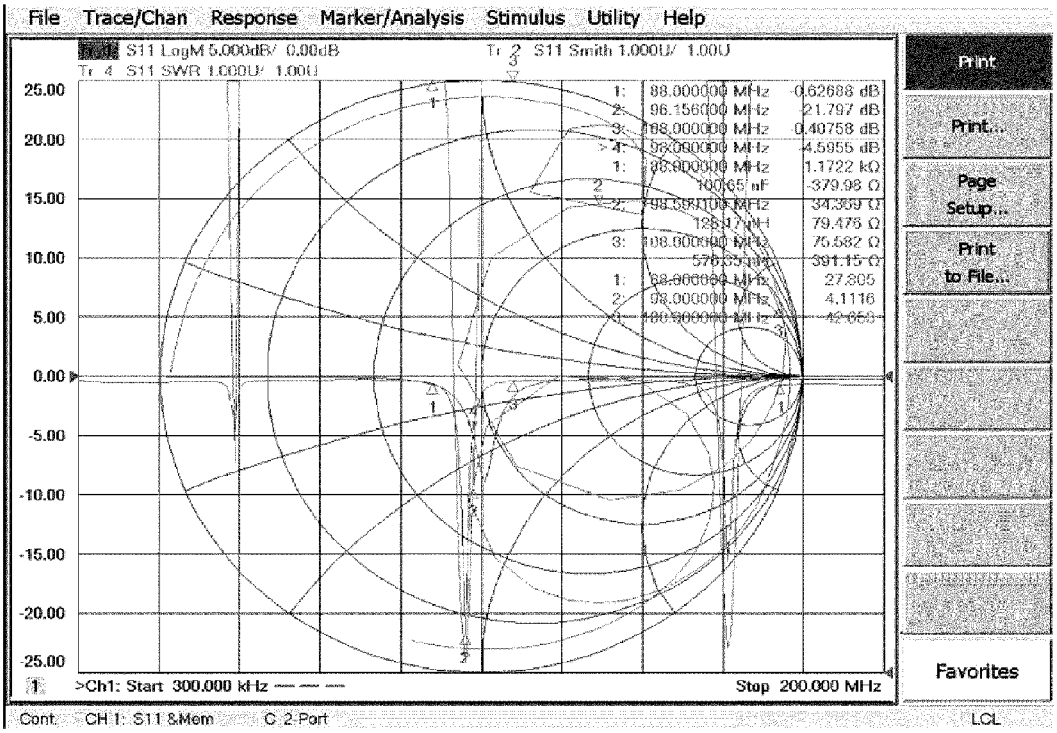
FIG. 4 is an exemplary diagram showing measuring data of a return loss by each frequency of an antenna for a vehicle according to an exemplary embodiment of the present invention.

FIGS. 2 and 3 are exemplary views illustrating a structure of an antenna for a vehicle according to an exemplary embodiment of the present invention. FIG. 4 is an exemplary diagram showing measuring data of a return loss by each frequency of an antenna for a vehicle according to an exemplary embodiment of the present invention.

Referring to FIGS. 2 to 4, the antenna 100 for the vehicle according to an exemplary embodiment of the present invention may include a base 110, a first printed circuit board 120, a second printed circuit board 130, and a monopole antenna 140. The antenna 100 for the vehicle may be a shark pin antenna mounted to a loop of the vehicle.

The base 110 forms a lower part of the antenna for the vehicle 100, and the base 110 may be coupled to the case (not shown) to form a closed structure of the antenna for the vehicle 100. The case may protect the first printed circuit board 120, the second printed circuit board 130 and the monopole antenna 140 disposed on the upper part of the base 110. An attaching surface (not shown) may be formed on the lower part of the base 100 to be attached to the loop of the vehicle. The first printed circuit board 120 may be coupled to the upper part of the base 110. A feeding circuit may be formed within the first printed circuit board 120, and a feeding circuit of a various service bands such as a DMB signal, an AM/FM signal, a GPS, and a CDAM may be formed.

The feeding circuit formed within the first printed circuit board 120 may be coupled to an RF processing circuit inside the vehicle, and the RF signal received from the chip antenna (not shown) or the monopole antenna 140 may be provided to the RF processing circuit inside the vehicle. In particular, the chip antenna may be an antenna that transmits and receives the GSP signal and the CDMA signal. The chip antenna may be electrically coupled to the feeding circuit to feed the GPS or the CDMA signal. A first ground feeding point (not shown), two of a second ground feeding points (not shown), and a signal feeding point (not shown) may be formed within the first printed circuit board 120.

The second printed circuit board 130 may be coupled with the first printed circuit board 120 on the upper part of the first printed circuit board 120 in the vertical direction, and the second printed circuit board 130 may be coupled with the feeding point and the signal feeding point of the first printed circuit board 120. A first pattern 131 of a meander type may be formed on one side (e.g., a first side) of the second printed circuit board 130, and the monopole antenna 140 may be coupled to an end part of the first pattern 131. In particular, the meander type refers to an antenna pattern formed on the printed circuit board as winding.

The monopole antenna 140 may be configured to receive the DMB signal and the AM/FM signal. The monopole antenna may be in a coil type, and the monopole antenna 140 may be formed in the vertical direction to the second printed circuit board 130. A length and a diameter of the monopole antenna 140 may be set appropriately to receive the AM/FM signal which is a substantially low frequency band compare to the DMB, and may be about 100 mm.

The first pattern 131 and a reactive element 137 may be coupled to one side of the second printed circuit board 130. The first pattern 131 may include a first ground feeding unit 131*a* to be electrically connected to the first ground feeding point which is formed on the first printed circuit board 120, and a pattern unit 131*b* which is connected to a first ground feeding unit 131*a* and formed on one side of the second printed circuit board 130.

The first ground feeding unit 131*a* may be coupled to the first ground feeding point via a soldering, and may be coupled to the first ground feeding point by a plug structure. The pattern unit 131*b* may be formed to have a $\pi/2$ pattern. The pattern unit 131*b* may provide an inductance component to provide an impedance matching which corresponds to a second pattern 135 and a third pattern 136. The inductance component which is secured by the pattern unit 131*b* may be determined by a length and a number of a winding of the pattern unit 131*b*, and an increased inductance component may be obtained when an entire length increases and the number of the winding increases.

The reactive element 137 may be coupled to the pattern unit 131 to adjust impedance and may be connected to the monopole antenna 140. A capacitive element such as a capacitor and an inductive element such as an inductor may be used for the reactive element 137 according to the elements required for the impedance matching, and a plurality of the reactive elements may be used.

In addition, as a third pattern 136 and any one of the second patterns 135 may operate as a radiator and a coupling effect may generate in the first ground feeding unit 131*a*. Accordingly, the pattern unit 131*b* connected to the first ground feeding unit 131*a* may radiate the coupling signal generated from the first ground feeding unit 131*a*.

A pair of the second pattern 135 and the third pattern 136 which are formed as a meander type may be formed on one side of the second printed circuit board 130, and the second pattern 135 and the third pattern 136 may be connected as one. In particular, a pair of the second pattern 135 may be coupled to two of the second ground feeding points formed in the first printed circuit board 120 via the second ground feeding unit 134*a*, 134*b*. In addition, the third pattern 136 may be coupled to a signal feeding point formed in the first printed circuit board 120 via the signal feeding unit 133. A pair of the second pattern 135 and the third pattern 136 may be coupled to the second ground feeding point and the signal feeding point via the soldering or the plug structure.

A pair of the second pattern 135 and the third pattern 136 may be formed to have a $\pi/4$ pattern. When tuning a main frequency in the third pattern 136 through the second pattern 135 and the third pattern 136 which are formed as a $\pi/4$ pattern, when the frequency is included in a specific frequency (e.g., FM 88-108 MHz), the third pattern 135 and the second pattern 135*a* of the second pattern 135 may operate as a radiator. Further, another second pattern 135*b* of the second pattern 135 may be a dummy pattern, and may operate identically to the second pattern 135*a* to perform the main frequency tuning.

When the second pattern 135 and the third pattern 136 operate as the radiator, the coupling effect may be generated by the second pattern 135 and the third pattern 136 which operate as the radiator in the first ground feeding unit 131*a* of the first pattern 131 formed on one side of the second printed circuit board 130. In addition, the pattern unit 131*b* of the first pattern 131 formed on one side of the second printed circuit board 130 may operate as the radiator radiating the coupling signal generated from the first ground feeding unit 131*a*. Likewise, the first pattern 131 formed as a $\pi/2$ pattern may minimize the return loss by providing an impedance matching which corresponds to the second pattern 135 and the third pattern 136 formed as the $\pi/4$ pattern.

As shown in the measuring data of FIG. 4, the return loss is −21 dB when the frequency is 96 MHz, the return loss is 0 dB when the frequency is 88 MHz or 108 MHz, and the return loss is −4 when the frequency is 98 MHz, and thus, the antenna for the vehicle 100 according to an exemplary embodiment of the present invention may minimize the return loss. In particular, 88 MHz and 108 MHz provide a compensation of −10 MHz and +10 MHz based on FM 98 MHz which is a reference frequency for which the second pattern 135 and the third pattern 136 operate as the radiator. In addition, 98 MHz is set as the reference frequency for the convenience of the description in an exemplary embodiment of the present invention, however, it clearly is not limited to thereto.

As described hereinabove, a feeding circuit of the chip antenna and the monopole antenna 140 provide a signal received by a RF processing circuit, and the RF processing circuit may be equipped within the vehicle, or may be mounted within the first printed circuit board 120 of the antenna for the vehicle 100.

The RF processing circuit may be provided as a band pass filter that filters a signal of the required frequency band such as the received DMB signal, the AM/FM radio signal, the GPS signal, and the CDMA signal to perform the filtering. In addition, the signal may be amplified by a low noise amplifier which lowers a noise figure by amplifying the filtered signal. Likewise, the present invention may improve the impedance matching of a radiation board by minimizing a return loss which is generated due to a loop ground effect of the vehicle. In addition, the present invention may receive a signal in various service bands by minimizing an effect of the vehicle loop ground by installing a monopole antenna which has a shorter length than a monopole antenna to an interior of a shark antenna.

Although exemplary embodiments of the present invention have been described in detail hereinabove, it should be clearly understood that many variations and modifications of the basic inventive concepts herein taught which may appear to those skilled in the present art will still fall within the spirit and scope of the present invention, as defined in the accompanying claims.

What is claimed is:

1. An antenna for a vehicle comprising:

a base in which an attaching surface attached to the vehicle is formed;

a first printed circuit board coupled to an upper part of the base, in which at least one ground feeding point is formed;

a second printed circuit board coupled to the first printed circuit board in a vertical direction on the upper part of the first printed circuit board; and a monopole antenna coupled to a first side of the second printed circuit board, wherein a first pattern radiates a coupled signal by being coupled to the ground feeding point electrically on the first side of the second printed circuit board, and wherein a third pattern connected to a signal feeding unit is formed on a second side of the second printed circuit board.

2. The antenna for the vehicle of claim 1, wherein a pair of a second patterns connected to a ground feeding unit are formed on the second side of the second printed circuit board, wherein the ground feeding unit is connected respectively to a pair of ground feeding points formed in the first printed circuit board.

3. The antenna for the vehicle of claim 2, wherein the second pattern and the third pattern are connected respectively.

4. The antenna for the vehicle of claim 3, wherein the second pattern and the third pattern are formed as a meander type, and as a $\lambda/4$ pattern.

5. The antenna for the vehicle of claim 2, wherein one of the second patterns and the third pattern operate as a radiator in a specific frequency and another second pattern operates for frequency tuning.

6. The antenna for the vehicle of claim 5, wherein the first pattern includes:

a first ground feeding unit connected to the ground feeding point in which a coupling effect is generated, when one of the second patterns and the third pattern operate as a radiator; and a pattern unit connected to the first ground feeding unit and radiates a coupled signal generated from the first ground feeding unit.

7. The antenna for the vehicle of claim 6, wherein the pattern unit is formed as a meander type and formed as a $\lambda/2$ pattern.

* * * * *